US007694860B2

(12) United States Patent
Clifton, Jr.

(10) Patent No.: US 7,694,860 B2
(45) Date of Patent: Apr. 13, 2010

(54) HANDGUN LOCKING DEVICE AND HOLSTER

(75) Inventor: Norman E. Clifton, Jr., Jacksonville, FL (US)

(73) Assignee: Safariland Ltd, Inc. CA (US)

( * ) Notice: Subject to any disclaimer, the term of this patent is extended or adjusted under 35 U.S.C. 154(b) by 322 days.

(21) Appl. No.: 11/038,915

(22) Filed: Jan. 20, 2005

(65) Prior Publication Data

US 2006/0157520 A1 Jul. 20, 2006

(51) Int. Cl.
*F41C 33/02* (2006.01)

(52) U.S. Cl. ..... 224/243; 224/911; 224/198

(58) Field of Classification Search ..... 224/911, 224/912, 243, 244, 245, 246
See application file for complete search history.

(56) References Cited

U.S. PATENT DOCUMENTS

| | | | | | |
|---|---|---|---|---|---|
| 468,556 | A * | 2/1892 | Anderson | 224/230 |
| 2,088,811 | A * | 8/1937 | Ray | 224/243 |
| 3,420,420 | A * | 1/1969 | Clark | 224/243 |
| 4,094,450 | A * | 6/1978 | Parlante et al. | 224/243 |
| 5,275,317 | A * | 1/1994 | Rogers et al. | 224/244 |
| 5,509,591 | A * | 4/1996 | Carver | 224/244 |
| 5,918,784 | A * | 7/1999 | Serpa | 224/244 |
| 5,944,239 | A * | 8/1999 | Rogers et al. | 224/193 |
| 6,092,703 | A * | 7/2000 | Johnson | 224/198 |
| 6,112,962 | A * | 9/2000 | Matthews | 224/243 |
| 2002/0134803 | A1 * | 9/2002 | Lowe et al. | 224/243 |
| 2005/0279788 | A1 * | 12/2005 | Lowe et al. | 224/244 |

* cited by examiner

*Primary Examiner*—Tri M Mai
(74) *Attorney, Agent, or Firm*—Arthur G. Yeager

(57) ABSTRACT

Handgun locking apparatus for securing a handgun in a holster includes a lever member including a body having a forward and rear end portion mounted to the holster and a spring element projecting forwardly and outwardly from the front end portion of the body for contacting an interior surface of a holster for biasing the body against a handgun. A locking flange on the forward end contacts a handgun to positively engage a portion of a handgun to inhibit withdrawal of a holstered handgun. An operating arm extends rearwardly from the rear end portion of the body for moving the body away to move the locking flange away from a handgun. A positioning member is affixed inside a holster for engaging a handgun inserted in a holster to position a portion of a handgun in contact with the locking flange. A tension device is mounted to the inside of the holster for positioning the gun properly with respect to the locking apparatus.

25 Claims, 8 Drawing Sheets

HANDGUN LOCKING DEVICE AND HOLSTER

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to safety devices to inhibit unauthorized or accidental withdrawal of a handgun from a holster, and particularly to spring-loaded locking devices that fit into and against the sides of an ejection port of a handgun.

2. Relevant Art

A wide variety of safety devices exist to inhibit withdrawal of a handgun from a holster by anyone other than the user. What is desirable is an improved locking device that is safe and allows for rapid withdrawal of a handgun when necessary but greatly reduces the likelihood of accidental or unauthorized movement of the gun. In addition, the safety devices should be compatible with other safety devices to further enhance the security of the user.

BRIEF SUMMARY OF THE INVENTION

In one aspect of the present invention there is provided a handgun locking apparatus for securing a holsterable handgun in a holster having a body and an interior cavity comprising a lever member having a forward portion and a rearward portion, means for movably mounting the lever member to a holster, the lever member having a locking member for positively engaging a portion of a handgun for locking a handgun in holstered position inside a holster to inhibit the withdrawal of a handgun from a holster. The rearward portion of the lever member is movable by a user to pivot said locking member away from a handgun for allowing a handgun to be withdrawn from a holster. Also included is a tension member locatable in a holster for positioning a handgun inserted into a holster into contact with the locking member. The lever member includes a forward spring member extending outwardly from the forward portion of the lever member for contacting the body of a holster for biasing the forward portion of the lever member towards a holstered handgun to locate the locking member into positive engagement with a handgun holstered in a holster. There is also a molded cavity in the body of a holster, said cavity having an interior surface spaced away from the forward portion of the lever member to allow for movement of the forward portion of the lever member away from a holstered handgun a sufficient distance to allow for withdrawal of a handgun from a holster. The means for movably mounting the lever includes a pair of spaced posts affixed to the lever member for pivotally mounting the lever member to and inside a holster. The rearward portion of the lever member includes an operating arm for operating the lever member to move the locking member away from a handgun for allowing withdrawal of a handgun carried in a holster. The operating lever arm includes a thumb pad for engagement of the operating lever arm by a user for operating the lever member. The lever member includes a passageway therethrough for a fastener for affixing the lever member to a holster. The locking member is sized to fit against an edge of an ejection port of a handgun.

In another aspect of the invention, there is provided a handgun locking apparatus for securing a holsterable handgun in a holster having a body and an interior cavity comprising a lever member having a forward portion and a rearward portion, the forward portion of the lever member having an outer surface and an inner surface including at least one locking member for positively engaging a portion of a handgun to lock a handgun in a holster to inhibit the withdrawal of a handgun from a holster, means for pivotally mounting the lever member in the cavity, the rearward portion of said lever member being movable by a user to pivot the locking member away from the handgun for allowing a handgun to be withdrawn from a holster and a tension member in a holster for positioning a handgun into contact with the locking member. The lever member includes a spring member extending outwardly from the forward portion of the lever member for contacting the body of a holster for forcing the forward portion of the lever member to a position to locate the locking member into contact with a handgun holstered in a holster. The means for pivotally mounting includes a pair of spaced posts affixed to the lever member for pivotally mounting the lever member to a holster. The rearward portion of the lever member includes an operating arm for pivoting the lever member to move the locking member away from a handgun for allowing withdrawal of a handgun carried in a holster. The rearward portion of the lever member includes a flange for affixing the lever member to a holster, the flange having a passageway therethrough for a fastener for affixing the lever member to a holster. The locking member is sized to fit against an edge of an ejection port of a handgun.

In a further aspect of the present invention there is provided a handgun locking apparatus for securing a holsterable handgun comprising a holster for carrying a handgun, the holster including a pair of side walls each having forward and rearward edge portions, the side walls joined along respective forward and rearward edge portions to define an interior cavity having a front and rear wall portion, a lever member including a body having a forward and rear portion, a spring element projecting forwardly and outwardly from the front portion of the body for contacting the front wall portion for biasing the body against a handgun carried in the holster, means for movably mounting the body to the holster, the body including a locking flange for positively engaging a handgun to inhibit withdrawal of a handgun, an operating arm extending rearwardly from the rear portion of the body for moving the body away from a handgun to move the locking flange away from a handgun when the operating arm is moved from a first position, a positioning member affixed to the rear wall portion of the cavity for engaging a handgun inserted in the holster to position a portion of a handgun in the holster cavity. The body of the lever member is arcuate in shape, having an outer surface positioned away from the forward wall portion of the cavity and an inner surface formed to provide the locking flange. The locking flange includes a projecting boss sized to fit with a portion of an ejection port of a handgun to inhibit withdrawal of a handgun. The locking flange includes a surface or projecting boss, being positionable against a forward edge of an ejection port of a handgun, to inhibit upward movement of a handgun until released by the lever. The body of the lever member includes at least one sloping surface for guiding the movement of a handgun being inserted into the interior cavity of said holster. The locking flange includes an extension arm extending forwardly of the forward portion of the body and a blocking member integral with the extension arm positionable closely adjacent a portion of a handgun for inhibiting withdrawal of a handgun from the holster.

An additional aspect of the present invention provides a handgun locking apparatus for securing a handgun in a holster comprising a lever member including a body having a forward and rear end portion, a spring element projecting forwardly and outwardly from the front end portion of the body for contacting an interior surface of a holster for biasing the body against a handgun carried in a holster, means for movably mounting the body to a holster, the body including a locking flange for contacting a handgun to inhibit withdrawal of a holstered handgun, an operating arm extending rearwardly from the rear end portion of the body for moving the body away from a handgun to move the locking flange away from a handgun when the operating is moved from a first position where the locking flange is in contact with a handgun to a second position, a positioning member affixed inside a holster for engaging a handgun inserted in a holster to position a portion of a handgun in contact with the locking flange.

Also included is a handgun positioning device having a body including a movable arm member having a handgun contacting surface and a camming surface. The body further includes a holster engaging surface and a movable member carried by the body and in contact with the camming surface for moving the arm member to position the handgun contacting surface against a handgun for forcing the arm member to position the handgun contacting surface against a handgun for forcing a handgun into a first position, and means to rigidly mount the device inside a handgun holster. The body further includes a trigger guard-contacting surface for limiting downward travel of a handgun in a holster. Also the movable member includes a threaded rod mounted in the body, the threaded rod having a first end portion in contact with the camming surface and a second end portion adapted for rotation of the threaded rod by a user for moving the handgun-contacting surface.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
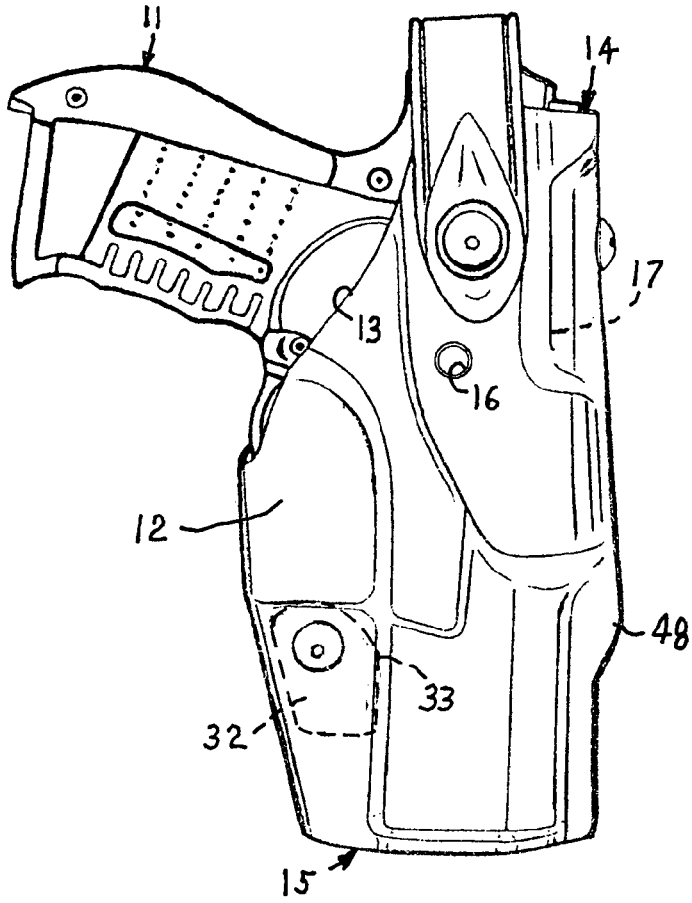
FIG. 1 is a side view of a holster having an interior molded surface in accord with the present invention.

FIG. 1 illustrates a holster 10 containing a holstered handgun 11 in interior cavity 13 formed by holster body 12. Body 12 is a rigidly molded structure with an interiorly disposed portion 14 adjacent the ejection port of handgun 11 or any other surface that can be engaged to inhibit withdrawal of the handgun 11.

The interior cavity 13 of the holster 10 is molded for a specific model of handgun 11 and includes space for a spring-loaded ejection port locking device shown generally at 18 in FIGS. 2-7

The specific locking device 18 shown in FIGS. 2-7 is mounted via mounting posts 22 extending outwardly from mounting arms 21 of body 19 that fit within mounting holes 16 of holster 10. An alternate construction of a locking device will be discussed hereinbelow. An integrally formed operating lever 20 has a thumb pad 24 on an end thereof.

Figure 10:
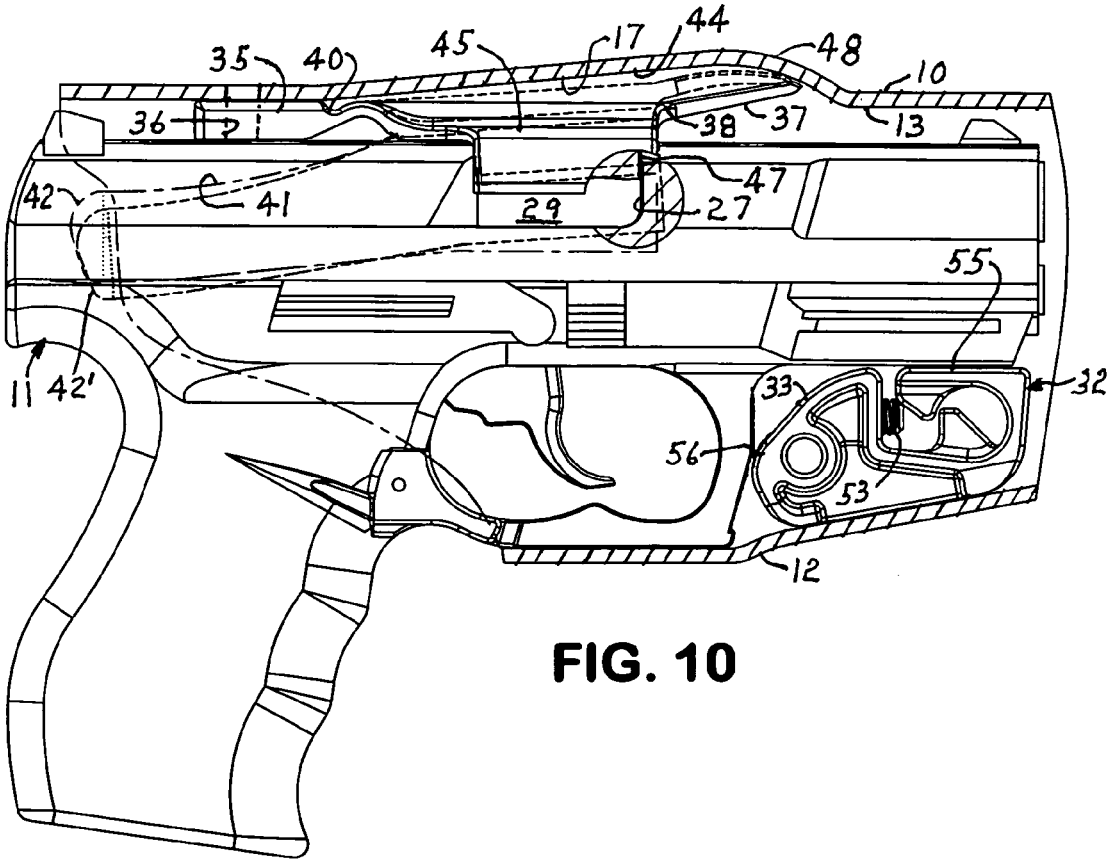
FIG. 10 is a side view of a handgun showing the relationship of a lock of FIG. 8 to a handgun.
Figure 11:
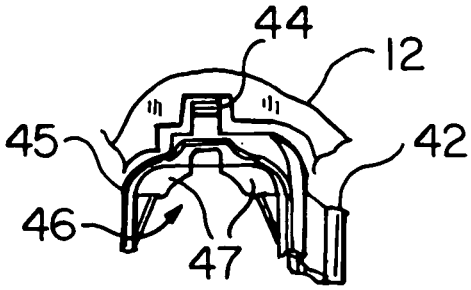
FIG. 11 is a rear view of the lock of FIG. 8 showing its relationship to an interior surface of a holster.
Figure 12:
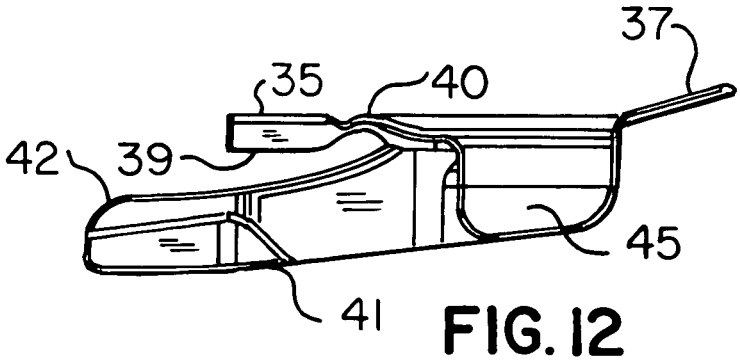
FIG. 12 is a side view of the lock of FIG. 1.

The body or saddle 19 of locking device 18 is formed to engage upward surfaces of a specific handgun 11 to position the gun properly in the holster and includes an interiorly disposed ejection port indexing edge 26 that fits against respective front edge 27 of the right-side ejection port 29 of handgun 11 (FIG. 10). Preferably, an opposed pair of spaced indexing edges 30,31 are also molded into device body 19 to fit against a handgun to also assist in positioning the gun with respect to the device 18.

When locking device 18 is secured inside holster 10, it will rest slightly below the mating surface created by molded cavity 17. As will be described in more detail below, the insertion of handgun 11 into holster cavity 13 against angled locking saddle surface 23 will cause the locking device 18 to be pushed into cavity 17 forcing locking edge 26 into ejection port 29 and against locking front edge 27. From this position it will be necessary to move the locking edge 26 away from ejection port 29 to withdraw a handgun 11 upwardly out of the holster. The angled locking saddle surface 23 may be defined as at least one sloping surface to guide the handgun into its proper seated position in the holster.

From the directions referenced in FIG. 1, rearward movement of operating arm 20 by pressure on thumb pad 24 will cause the main body 19 of device 18 to pivot about post axis 22A toward cavity 17. The locking edge 26 will move away from port edge 27 a sufficient distance to allow the handgun 11 to be withdrawn from the holster 10. Forward spring element or spring member 19A is bendable around pivot portion 19B as operating lever arm 20 is pushed rearwardly causing body 19 to move away from handgun 11. The member 19A normally rests against the interior surface of molded cavity 17 and applies a rearward force onto the handgun while the positioning member or tension device 32 maintains proper positioning of the handgun 11 in the holster cavity 13.

An adjustable tension device (ATD) 32 is fixed to the interior cavity 13 of the holster 10. As handgun 11 is inserted into holster 10, the handgun 11 will come into contact with an angled funneling surface portion 33 of ATD 32 and position the handgun 11 against the locking device 18 to place the locking surface 26 of device 18 into contact with ejection port 29 of handgun 11. The handgun 11 will be locked into place with locking edge 26 against edge 27 of port 29. Tension device only is for muzzle location and applying tension on the holstered pistol, i.e., to give resistance during draw of handgun and take up loose play between pistol and holster.

With respect to FIGS. 8-12, a second embodiment of a spring-loaded ejection port lock 34 is illustrated. A mounting pad 35 includes a hole 36 therethrough for passage of a fastener to rigidly affix lock device 34 to the interior cavity 13 of a holster 10. Mounting holes 16 (FIG. 1) would not be formed in the holster when using lock device 34.

Pad member 35 is part of a forward lever 39 that is movable about a first pivot portion 40. A second spring member 37 is movable about a second pivot portion 38. An operating arm 41 has a thumb pad 42 adjacent a hook member 43 used to movably position arm 41 to a portion of holster body 12 as clearly shown in partial cross-section in FIG. 9.

The upper surfaces of the main body 45 of locking device 34 fit spaced away from a molded cavity 44 that is formed to accommodate the lock 34 in a manner similar to the fitting of lock 18 into cavity 17. Spring lever arm 37 fits within cavity 44 (as shown by bulge 48 in FIG. 1).

FIGS. 8-12 illustrate the arrangement of the ejection port lock 34 with respect to a specific handgun 11. Interior surfaces 46 include a locking surface 47 usable against an ejection port in a manner substantially identical to that described hereinabove with respect to FIG. 1-7.

Figure 13:
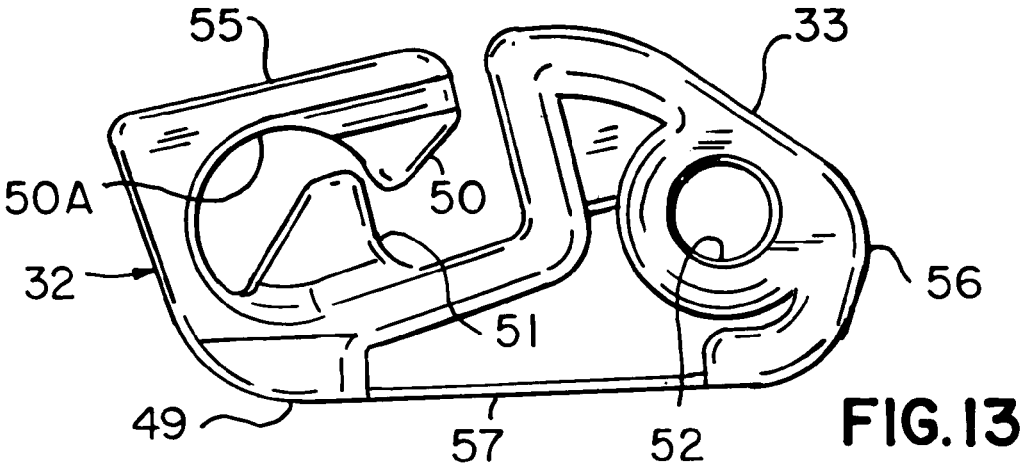
FIGS. 13 and 14 illustrate two views of an adjustable tension device in accord with the present invention.
Figure 14:
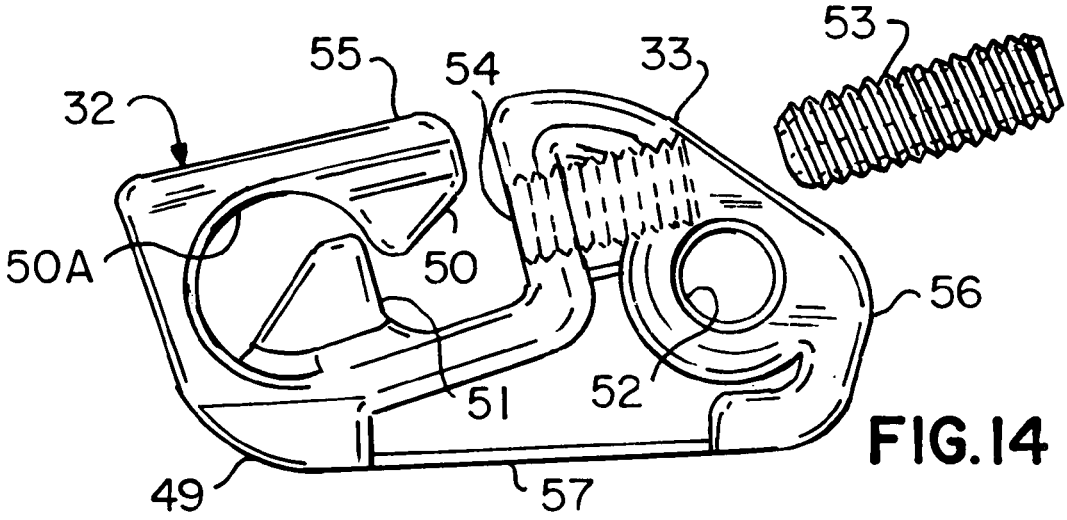

FIGS. 13-14 illustrate the adjustable tension device 32. Body 49 is preferably formed of hard plastic material and is mounted via hole 52 to holster 10 and includes a camming surface 50 integral with an arm member 50A and which is movable slightly upwardly by a screw 53 mounted in threaded hole 54. Member 51 provides a travel limit for screw 53. Upper surface 55 is adjusted via screw 53 to contact the handgun 11. Rearward surface 56 contacts the trigger guard of a handgun 11 and functions as a gun travel limit. Lower surface 57 rests against the spine of a holster 10.

Figure 15:
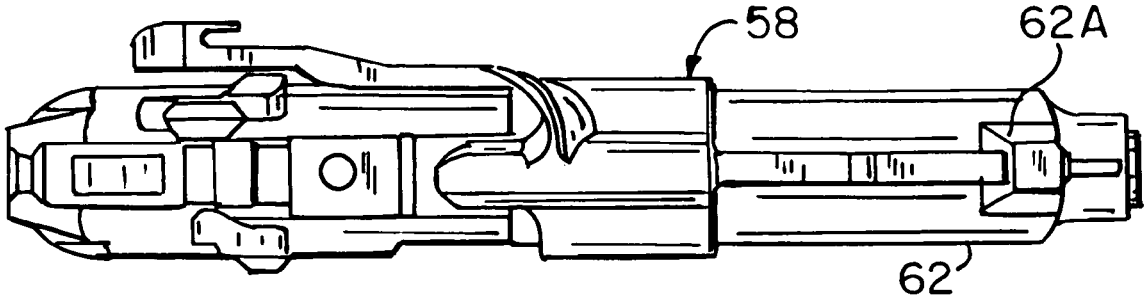
FIGS. 15-17 illustrate an alternate embodiment of the locking device in accord with the present invention.
Figure 16:
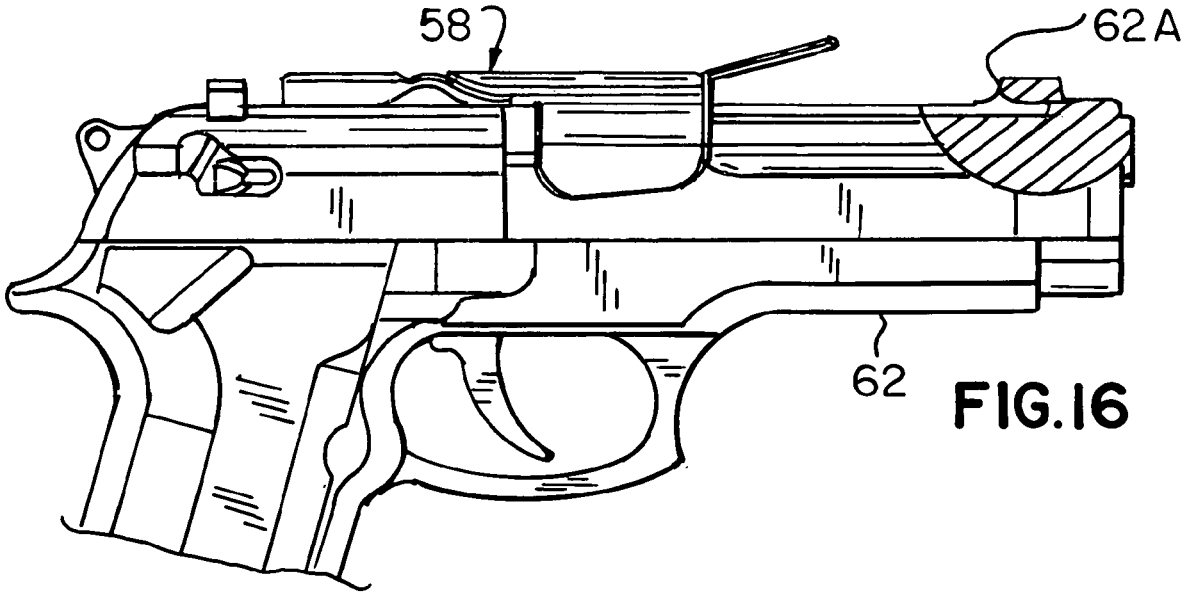
Figure 17:
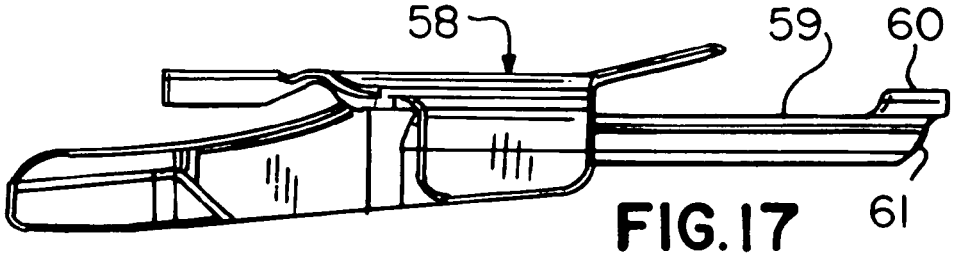

FIGS. 15-17 illustrate another embodiment of a locking device 58. With the exception of forward extension arm 59 the device 58 is identical to the lock 34. Extension arm 59 includes an enveloping hood 60 at the end 61 thereof. Hood 60 fits against the radiused detail 62A on weapon 62 or the forward muzzle sight of a handgun 62 to hold the gun in the holster 11.

Figure 22:
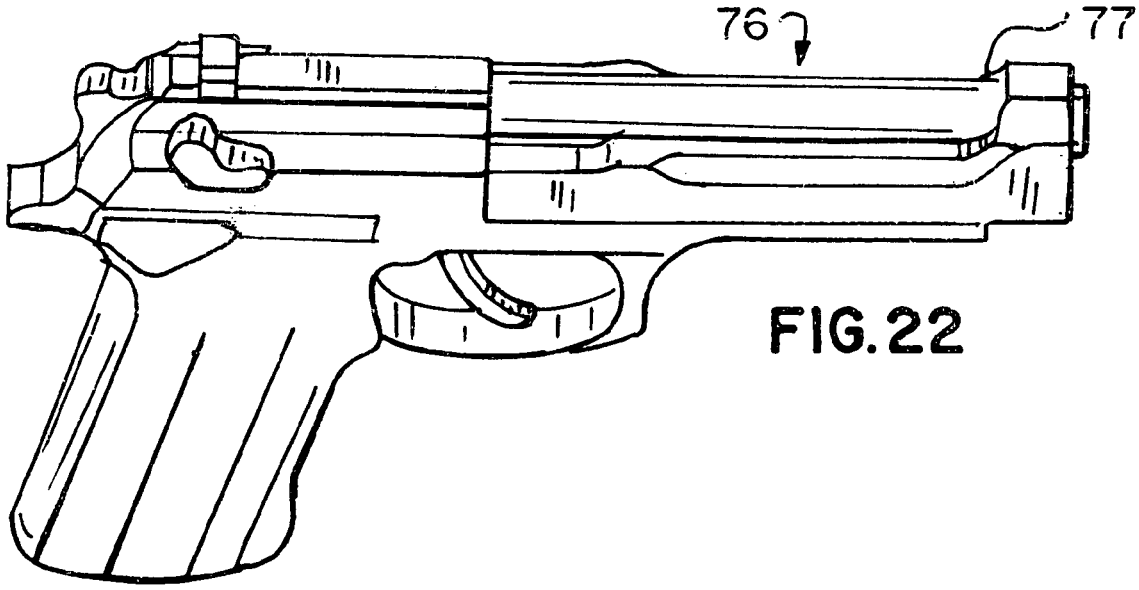
FIG. 22 is a pictorial view of a handgun to be secured by the locking device of FIGS. 19-20.
Figure 2:
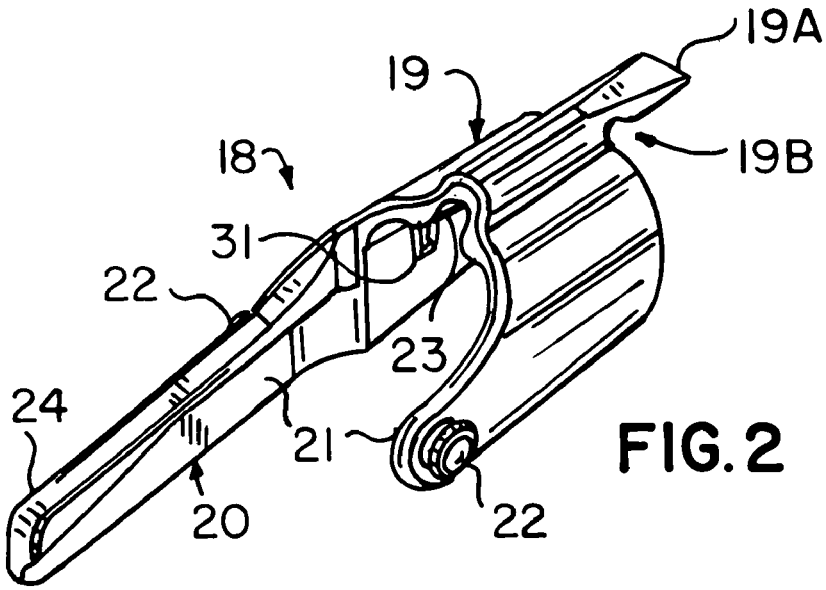
FIG. 2 is a rearward perspective view of the spring-loaded ejection port lock in accord with the present invention for use with the holster of FIG. 1.
Figure 4:
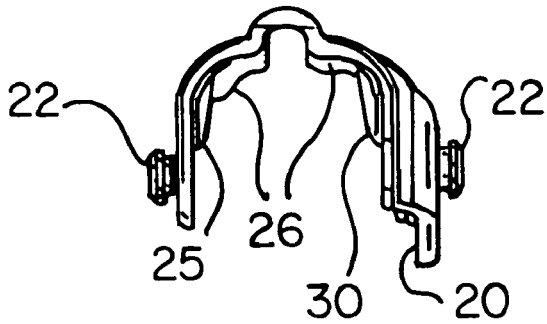
FIG. 4 is a front view of the lock of FIG. 1.
Figure 7:
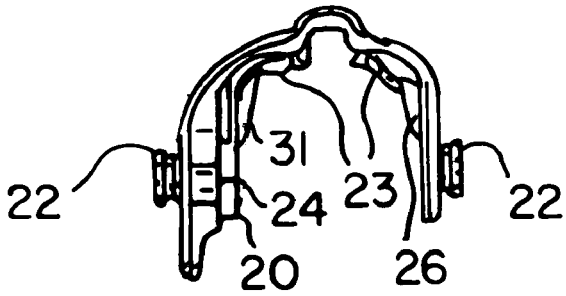
FIG. 7 is a rear view of the lock of FIG. 1.
Figure 3:
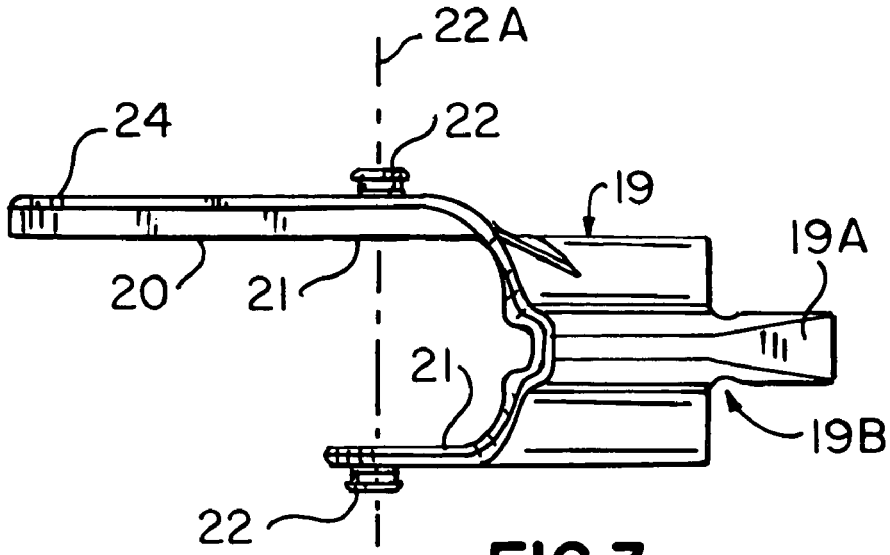
FIG. 3 is a top view of the lock of FIG. 2.
Figure 5:
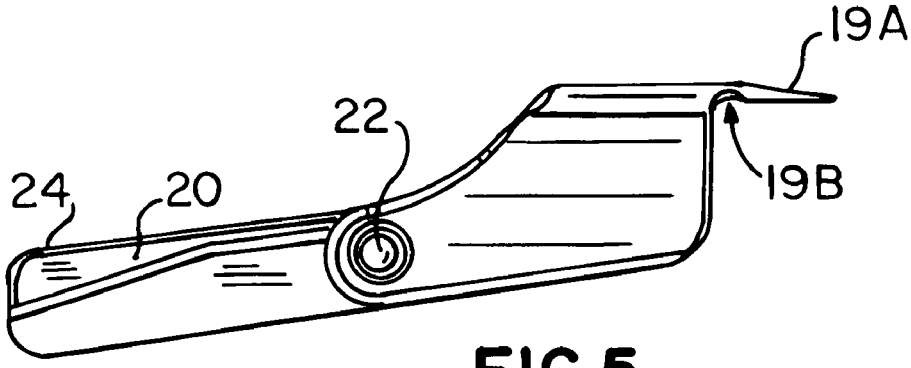
FIG. 5 is a side elevation of the lock of FIG. 1.
Figure 6:
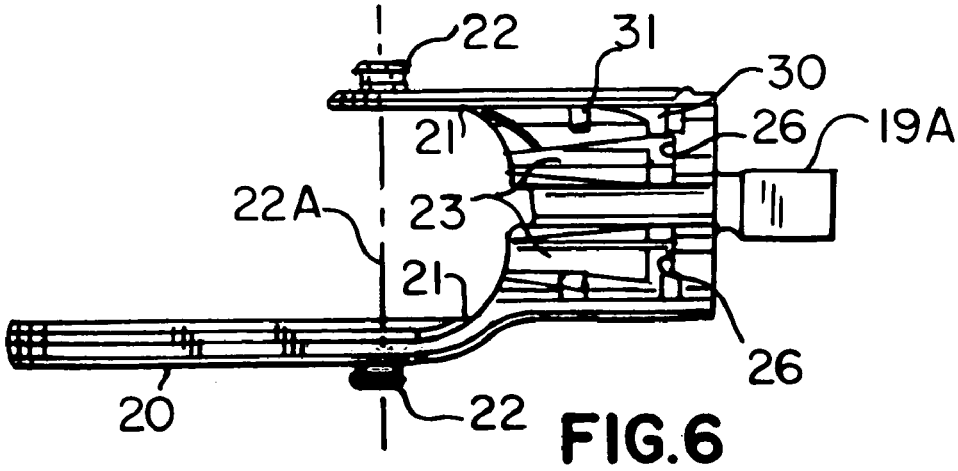
FIG. 6 is a bottom view of the lock of FIG. 1.
Figure 8:
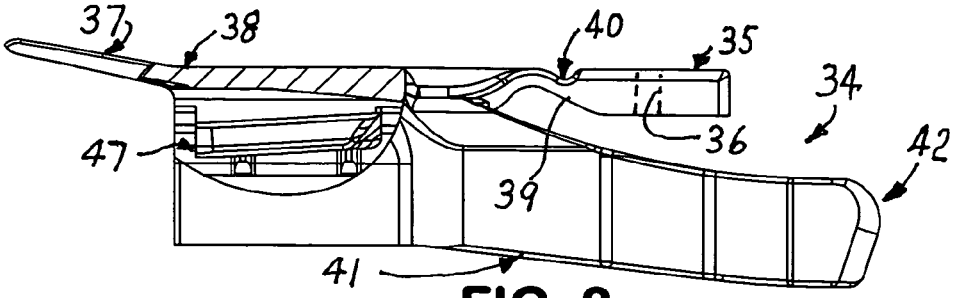
FIG. 8 is a side view of the port lock in accord with the present invention showing a partially cutaway section illustrating an interior surface feature of the lock.
Figure 9:
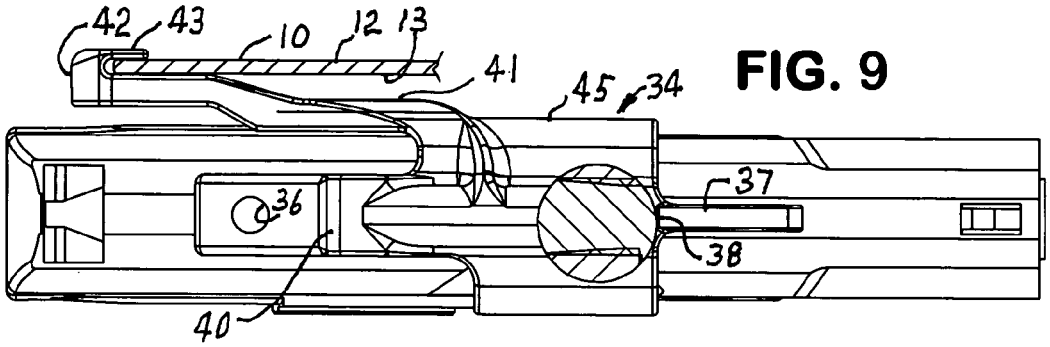
FIG. 9 is a top view of the lock of FIG. 8 partially cutaway and fitted over a handgun.

Lock device 58 is employed for certain firearms that do not include a sufficient locking surface adjacent the main body or saddle 45, for example the firearm depicted in FIG. 22. Thus the lock device 58 need not include locking edges 26 and 47 but will include a forward locking surface, such as 64A or 66A.

Figure 23:
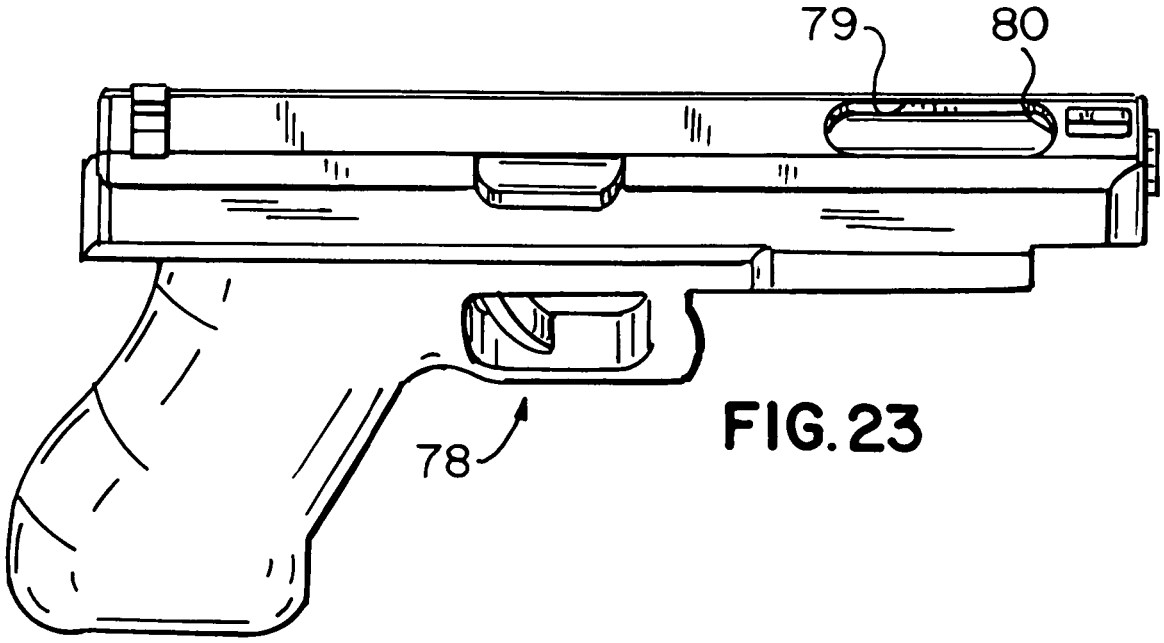
FIG. 23 is a pictorial view of a handgun to be secured by the locking device of FIG. 18.
Figure 18:
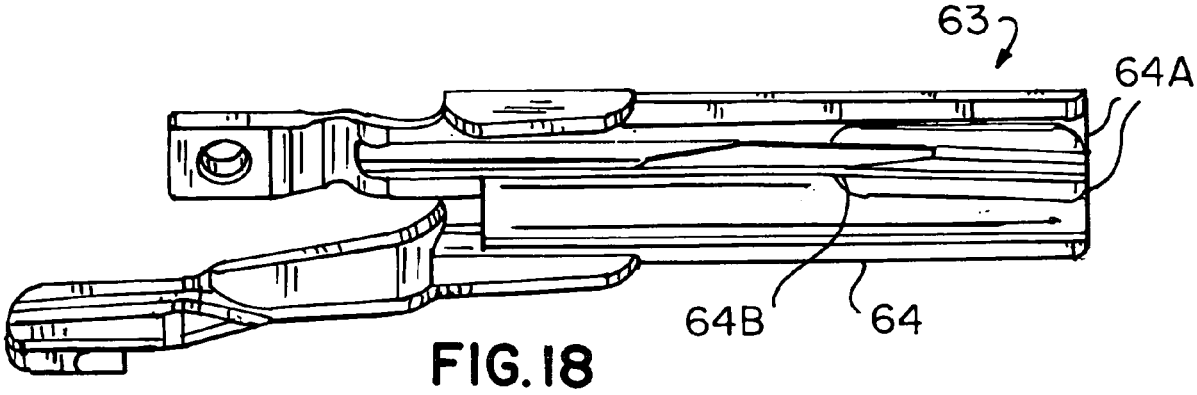
FIG. 18 illustrates another embodiment of the locking device in accord with the present invention.

With respect to FIG. 18, another embodiment of a locking device 63 is shown in perspective. The lock 63 is substantially identical to lock device 34 with the exception of extension arm 64 which includes sloping surface 64B. Oval boss 64A fits within an oval-shaped lightening cut 79 and engaging shoulder 80 formed on Glock 78 (FIG. 23).

Figure 19:
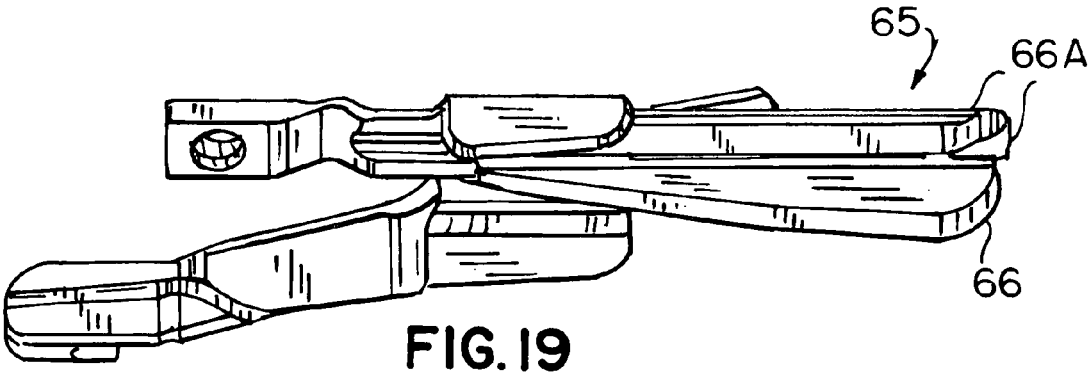
FIG. 19 is another view of the locking device in accord with the present invention.
Figure 20:
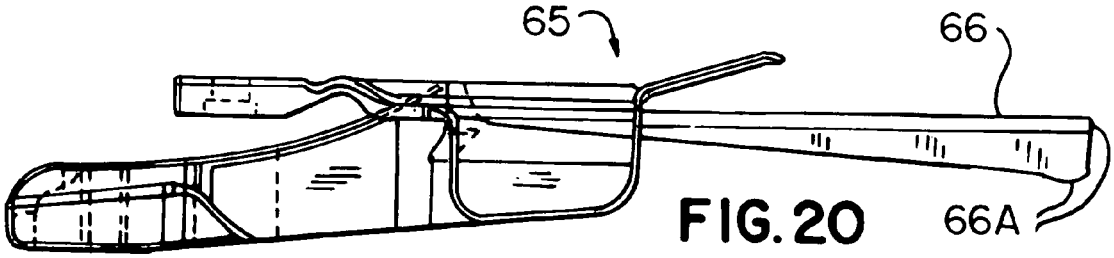
FIG. 20 is another view of the locking device of FIG. 19.

FIGS. 19-20 illustrate another locking device 65 that is substantially identical to the device 34 with exception of the extension arm 66 and locking surface 66A, which is used with a particular firearm such as a Berretta 76 (FIG. 22).

Each of the locking devices disclosed hereinabove operates in the following manner. Each locking device has a forward portion with upper and lower surfaces and a rear portion with a pivot point between. The forward portion is pressed downwardly on a handgun in a holster and positively engages the gun at some area (such as ejection ports) to lock the gun in the holster to inhibit withdrawal of the gun. The lower surface of the saddle position includes angled or sloping surfaces which position the device over the gun slide and to center the device by directing movement of the handgun. Pressure on a rearward lever-operating arm causes the forward gun-engaging portion of the device to move away from the gun. The pivoting of the forward portion is around the mounting axle axis of device 18 or around a pivot area such as area 40 of devices 34, 58, 63 and 65. Spring members on the front of the device provide a means to push the device onto the gun but in a manner that allows for spacing between the locking portion body or saddle and the mating surface located in the front portion of the holster which provides sufficient space for unlocking the device from the gun by moving the locking portion body away from the locking features of the holstered firearm. The adjustable tension device such as 32 is provided to assist in positioning the gun in the holster to provide for proper engagement between the handgun and the locking device.

The exact dimensions of the locking devices and mating surfaces depend on the specific handgun involved.

Figure 21:
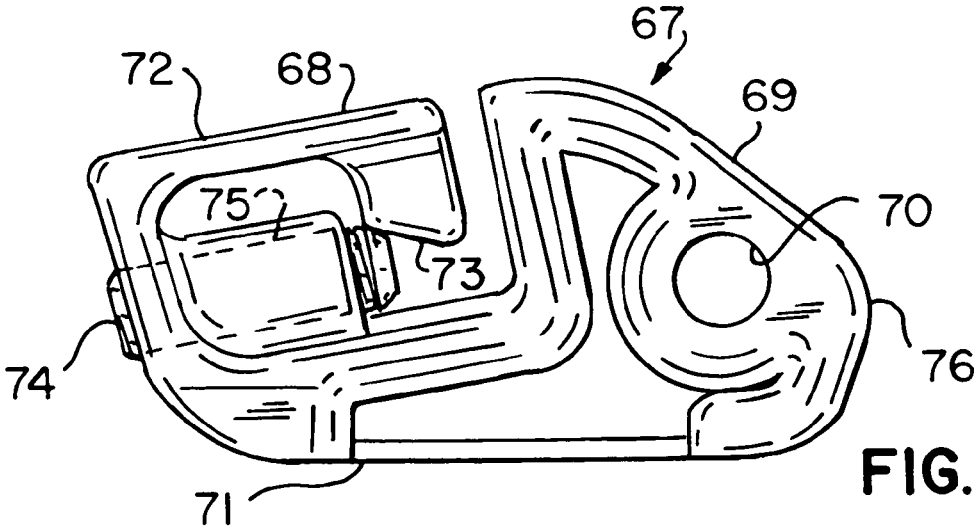
FIG. 21 is another embodiment of an adjustable tension device in accord with the present invention.

If the holster 10 used has an open muzzle end, the preferred tension device used will be the device 67 mounted in the holster by a screw passing through opening 70, illustrated in FIG. 21. The gun contacting surface 68 is integral with arm member 72 carrying a camming surface 73. Camming surface 73 is in contact with adjustment screw 74 threaded through passageway 75. Bottom surface 71 rests against the spine or rearward portion of a holster 10. A gun-contacting surface 76 contacts the trigger guard of a handgun and provides a travel limit for a handgun 11 in holster 10. Adjustment screw 74 is accessible through an open muzzle end of a holster 10 thus making adjustments faster and more convenient.

A number of other devices such as rollers and wedge-shaped blocks can be used in lieu of ATD's 32 and 67. ATD's 32, 67 are preferred devices because they are adjustable in order to provide a correct positioning of the handgun and the locking devices discussed herein.

The forward spring members, such as member 19A, are shown as integral plastic elements, it is important to note that the spring members may in fact be other devices such as coil springs that are attached to the main body of a given locking device. In addition, operating arms are also shown as integral with the locking device body of a particular embodiment. It is to be understood that such arms can be separate members attached to the device body by any appropriate means.

The devices shown in FIGS. 1-20 are designed for a right-hand draw. Devices for a left-hand draw are mirror images of respective right-hand devices and are otherwise substantially identical in structure and operation.

While the invention has been described with respect to certain specific embodiments, it will be appreciated that many modifications and changes may be made by those skilled in the art without departing from the true spirit of the invention.

It is intended therefore, by the appended claims to cover all such modifications and changes as fall within the true spirit and scope of the invention.

What is claimed as new and what it is desired to secure by Letters Patent of the United States is:

1. Handgun locking apparatus for securing a holsterable handgun in a holster having a rigidly molded body with front and rear portions and an interior cavity with a long axis extending from an open top to a bottom of said holster comprising a lever member having a forward portion and a rearward portion, means adjacent said rearward portion for movably mounting said lever member in said cavity of and to said holster, said lever member having a locking member within said cavity for positively engaging a portion of the handgun remote from said rearward portion of said lever and remote from a trigger guard of the handgun for locking the handgun in holstered position inside said holster to inhibit withdrawal of the handgun from said holster, said rearward portion of said lever member being movable by a user to pivot about a pivot axis located closely adjacent said rearward portion of said lever and perpendicularly with respect to said long axis of said holster and to move said locking member toward said front portion of said holster and away from the handgun for allowing the handgun to be withdrawn from said holster.

2. The apparatus as defined in claim 1 wherein said lever member includes a forward spring member unattached to and for contacting said body of said holster for biasing said locking member of said lever member away from said front portion of said holster and towards the handgun to locate said locking member into positive engagement with the handgun in said holster.

3. The apparatus as defined in claim 1 wherein said cavity has an interior surface spaced away from said forward portion of said lever member to allow for movement of said forward portion of said lever member away from the handgun a sufficient distance to allow for withdrawal of the handgun from said holster.

4. The apparatus as defined in claim 1 wherein said means for movably mounting includes a pair of spaced posts affixed to said lever member for pivotally mounting said lever member to and inside said holster.

5. The apparatus as defined in claim 1 wherein said rearward portion of said lever member includes an operating arm for operating said lever member to move said locking member away from the handgun for allowing withdrawal of the handgun carried in said holster.

6. The apparatus as defined in claim 5 wherein said operating lever arm includes an upper portion extending upwardly and outside said interior cavity of said holster and having a thumb pad for engagement of said operating lever arm by a user for operating said lever member.

7. The apparatus as defined in claim 1 wherein said lever member includes a passageway therethrough for a fastener for affixing said lever member to said holster.

8. The apparatus as defined in claim 1 wherein said locking member having a shoulder and engagable against an edge of an ejection port of the handgun.

9. The apparatus as defined in claim 1 wherein said locking member includes a locking flange for contacting the handgun remote from a trigger guard of the handgun to inhibit withdrawal of a holstered handgun, said rearward portion of said lever including an operating arm to move said locking flange away from the handgun when said operating arm is moved from a first position where said locking flange is in contact with a handgun to a second position unlocking the handgun, and a positioning member affixed inside said holster for engaging the handgun inserted in said holster to position a portion of the handgun in contact with said locking flange.

10. The apparatus as defined in claim 9 wherein said positioning member includes a body, said body including a movable arm member having a handgun contacting surface and a camming surface, said body further including a holster engaging surface, a movable member carried by said body and in contact with said camming surface for moving said arm member to position said handgun contacting surface against the handgun for forcing the handgun into a first position, and means to rigidly mount said positioning member inside said holster.

11. Handgun locking apparatus for securing a holsterable handgun in a holster having an elongated rigid body with front and rear portions and an open top and a bottom and a long interior cavity comprising an elongate lever member having a longitudinal axis extending generally parallel to said elongated body and said long cavity and having a forward portion and a rearward portion, said forward portion of said lever member having an outer surface and an inner surface including at least one locking member within said cavity for positively engaging a portion of the handgun remote from a trigger guard of the handgun to lock the handgun in said holster to inhibit withdrawal of the handgun from said holster, means within said cavity adjacent said rearward portion for pivotally mounting said lever member in said cavity, said lever having a pivotal axis extending perpendicularly with respect to said longitudinal axis and the length of said long cavity, said rearward portion of said lever member being engagable outwardly of said cavity and movable by a user to pivot said locking member toward said front portion of said holster and away from the handgun for allowing the handgun to be withdrawn from said holster, and a separate member within said cavity of said holster for positioning the handgun into contact with said locking member.

12. The apparatus as defined in claim 11 wherein said lever member includes a forward spring member extending outwardly from said forward portion of said lever member for contacting said cavity in said body of said holster for forcing said forward portion of said lever member to a position to locate said locking member into contact with the handgun holstered in said holster.

13. The apparatus as defined in claim 11 wherein said means for pivotally mounting includes a pair of spaced posts affixed to said lever member for pivotally mounting said lever member to said holster.

14. The apparatus as defined in claim 11 wherein said rearward portion of said lever member includes an operating arm for pivoting said lever member to move said locking member away from the handgun for allowing withdrawal of the handgun carried in said holster.

15. The apparatus as defined in claim 11 wherein said rearward portion of said lever member includes a mounting pad for affixing said lever member to and within said cavity of said holster, said mounting pad having a passageway therethrough for a fastener for affixing said lever member to said holster.

16. The apparatus as defined in claim 11 wherein said at least one locking member having a shoulder to engage against an edge of an ejection port of the handgun.

17. The apparatus as defined in claim 11 wherein said separate member includes a body, said body having a movable arm member with a handgun contacting surface and a camming surface, said body further including a holster engaging surface, a movable member carried by said body and in contact with said camming surface for moving said arm member to position said handgun contacting surface against the handgun for forcing the handgun into fully seated position within said holster, and means to rigidly mount said separate member to and within said holster.

18. In the holster as defined in claim 17 wherein said body further includes a trigger guard contacting surface for limiting downward travel of the handgun in said holster.

19. In the holster as defined in claim 17 wherein said movable member includes a threaded screw threadedly mounted in said body, said threaded screw having a first end portion in contact with said camming surface and a second end portion adapted for rotation of said screw by a user for moving said handgun contacting surface toward and away from the handgun to position the handgun in said holster.

20. In a handgun holster for securing a holsterable handgun comprising a holster for carrying a handgun, said holster including a pair of side walls each having forward and rearward edge portions, said side walls joined along respective said forward and rear edge portions define an elongate interior cavity having a front and rear wall portion, an elongate lever member including a body having a forward and a rear portion, said elongate lever and elongate interior cavity having respective elongate axis extending generally parallel, a spring element projecting forwardly and outwardly from said forward portion of said body for contacting said front wall portion of said cavity for biasing said body against the handgun carried in said holster, means adjacent said rear portion of said body for movably mounting said body within said cavity and to said holster, said body including a locking flange within said cavity for positively engaging the handgun remote from said rear portion of said lever and from a trigger guard of the handgun in a first position to inhibit withdrawal of a handgun, an operating arm extending rearwardly from said rear portion of said body of said lever for moving said body to a second position toward said forward edge portions of said holster and away from the handgun and to move said locking flange away from the handgun when said operating arm is moved from said first position to said second position.

21. In the holster as defined in claim 20 wherein said body of said lever member is arcuate in shape having an outer surface positioned away from said forward wall portion of said cavity and an inner surface defining said locking flange.

22. In the holster as defined in claim 21 wherein said locking flange includes a projecting boss engagable with a portion of an ejection port of the handgun to inhibit withdrawal of the handgun from said holster.

23. In the holster as defined in claim 21 wherein said locking flange includes a projecting boss, said boss being positionable against a forward edge of an ejection port of the handgun to inhibit withdrawal of the handgun from said holster.

24. In the holster as defined in claim 20 wherein said body of said lever member includes at least one sloping surface for guiding movement of the handgun being inserted into said interior cavity of said holster.

25. In the holster as defined in claim 24 wherein said at least one sloping surface includes an extension arm extending forwardly of said forward portion of said body and a blocking member integral with said extension arm positionable closely adjacent a portion of the handgun for inhibiting withdrawal of the handgun from said holster.

* * * * *